US012053076B2

(12) United States Patent
Lee

(10) Patent No.: US 12,053,076 B2
(45) Date of Patent: Aug. 6, 2024

(54) RETRACTABLE CONTAINER

(71) Applicant: Yonwoo Co., Ltd., Incheon (KR)

(72) Inventor: Jae Ock Lee, Incheon (KR)

(73) Assignee: YONWOO CO., LTD., Incheon (KR)

( * ) Notice: Subject to any disclaimer, the term of this patent is extended or adjusted under 35 U.S.C. 154(b) by 175 days.

(21) Appl. No.: 17/773,218

(22) PCT Filed: Sep. 24, 2020

(86) PCT No.: PCT/KR2020/012932
§ 371 (c)(1),
(2) Date: Apr. 29, 2022

(87) PCT Pub. No.: WO2021/085863
PCT Pub. Date: May 6, 2021

(65) Prior Publication Data

US 2022/0386757 A1 Dec. 8, 2022

(30) Foreign Application Priority Data

Oct. 29, 2019 (KR) ..... 10-2019-0135351

(51) Int. Cl.
*A45D 40/02* (2006.01)
*A24F 15/04* (2006.01)
(Continued)

(52) U.S. Cl.
CPC ..... *A45D 40/023* (2013.01); *A24F 15/04* (2013.01); *A24F 15/06* (2013.01); *A24F 15/14* (2013.01);
(Continued)

(58) Field of Classification Search
CPC .... A45D 2040/0018; A45D 2040/0025; A45D 40/10; B65D 83/0038; B65D 83/02;
(Continued)

(56) References Cited

U.S. PATENT DOCUMENTS 8,353,636 B2 * 1/2013 Drugeon ..... B65D 83/384 401/107
8,734,041 B2 * 5/2014 Hermouet ..... A45D 33/008 401/98
(Continued)

FOREIGN PATENT DOCUMENTS

KR 20-2009-0004520 U 5/2009
KR 20-2011-0003857 U 4/2011
(Continued)

*Primary Examiner* — Jennifer C Chiang
(74) *Attorney, Agent, or Firm* — Bridgeway IP Law Group, PLLC; Sang Ho Lee; Hyun Woo Shin

(57) ABSTRACT

A retractable container includes: a cover part of which both ends are open; a body part which is disposed in the upper inside portion of the cover part and receives contents; an elevating part which is disposed in the lower end of the body part, rises inside the cover part, and has a locking protrusion defining a seating position; a pressing part which is disposed in the lower portion of the elevating part, rises inside the cover part according to a user's pressing, and has an elastic piece; and a guide part which is fixedly disposed on the upper side of the pressing part and has a guide surface which contacts the upper end of the elastic piece, wherein, when the locking protrusion is seated on a first catching protrusion formed on the elastic piece, the rising of the elevating part and the body part is limited.

10 Claims, 7 Drawing Sheets

(51) Int. Cl.

| | |
|---|---|
| ***A24F 15/06*** | (2006.01) |
| ***A24F 15/14*** | (2006.01) |
| ***A24F 15/16*** | (2006.01) |
| ***A45D 40/10*** | (2006.01) |
| ***B65D 83/00*** | (2006.01) |
| ***B65D 83/02*** | (2006.01) |
| *A45D 40/00* | (2006.01) |

(52) U.S. Cl.
CPC ..... *A24F 15/16* (2013.01); *A45D 40/10* (2013.01); *B65D 83/0038* (2013.01); *B65D 83/02* (2013.01); *A45D 2040/0018* (2013.01); *A45D 2040/0025* (2013.01)

(58) Field of Classification Search
CPC ..... A24F 15/16; A24F 15/14; A24F 15/06; A24F 15/04
See application file for complete search history.

(56) References Cited

U.S. PATENT DOCUMENTS

| | | | | |
|---|---|---|---|---|
| 9,004,795 | B2 * | 4/2015 | Salciarini | A45D 40/10 401/109 |
| 10,888,147 | B2 * | 1/2021 | Zhong | A45D 34/00 |
| 2010/0209172 | A1 * | 8/2010 | Drugeon | B65D 83/384 401/55 |
| 2021/0085058 | A1 * | 3/2021 | Oh | A45D 40/04 |

FOREIGN PATENT DOCUMENTS

| | | | |
|---|---|---|---|
| KR | 10-2012-0097246 | A | 9/2012 |
| KR | 10-2012-0097267 | A | 9/2012 |
| KR | 20-2017-0001151 | U | 3/2017 |

* cited by examiner

RETRACTABLE CONTAINER

TECHNICAL FIELD

The present invention relates to a retractable container, and more particularly, to a retractable container of which a body part in which contents are accommodated may be extracted from or retracted into a cover part through a pressing operation on a pressing part.

BACKGROUND ART

In general, in lipsticks, stick cosmetics used for women's lip makeup, such as rouge, are extracted from or retracted into a cylindrical container. When lipsticks are used, the stick cosmetics are extracted from the container, and when the lipsticks are completely used, the stick cosmetics are retracted into the container and may be stored without being exposed to the outside.

In a lipstick container according to the related art, after a lid is opened, a rotating body provided at a lower portion of the container is rotated, and thus a solid stick cosmetic may be elevated to the outside of the container. For example, when a user wants to use the lipstick, first, the lid of the container is opened, the rotating body is rotated in one direction, and thus the stick cosmetic is elevated to protrude to the outside, and after the lipstick is used, the rotating body is rotated in a direction opposite to the one direction, and the stick cosmetic is lowered and is thus accommodated in the container.

However, since the lipstick container according to the related art is configured so that anyone may easily open the lid, the lipstick is damaged and wasted by children having low thinking ability. In addition, a malfunction occurs in which the lid is opened unintentionally by the user, and thus the lipstick is extracted. Accordingly, the lipstick is extracted while being carried or unintentionally by the user, and thus the lipstick is damaged and wasted, and items carried together and bags for carrying are contaminated.

DISCLOSURE

Technical Problem

The present invention is directed to providing a retractable container of which a body part in which contents are accommodated may be extracted from or retracted into a cover part through a pressing operation on a pressing part.

The technical aspects of the present invention are not limited to the aspects described above, and those skilled in the art will clearly understand other technical aspects not described from the following descriptions.

Technical Solution

According to one embodiment of the present invention, a retractable container is provided. One aspect of the present invention provides a retractable container including a cover part of which both ends are open, a body part which is disposed in an inner upper portion of the cover part and in which a content is accommodated, an elevation part that is disposed at a lower end of the body part, is elevated inside the cover part, and has a catching boss for determining a seating location, a pressing part which is disposed below the elevation part, is elevated inside the cover part according to pressing of a user, and has an elastic piece, and a guide part which is fixedly disposed on an upper side of the pressing part and has a guide surface in contact with an upper end of the elastic piece, wherein, when the catching boss is seated on a first catching step formed on the elastic piece, raising of the elevation part and the body part is limited, and when the pressing part is raised, the elastic piece is bent along the guide surface, the catching boss is separated from the first catching step, the elevation part is raised, and thus at least a portion of the body part protrudes from the cover part.

When the pressing is removed, outward bending of the elastic piece may be released by a restoring force of the elastic piece, and thus the pressing part may be lowered to return to an original location thereof.

As the catching boss separated from the first catching step is seated on a second catching step formed on the guide part, the raising of the elevation part may be limited, and separation of the elevation part may be prevented.

The retractable container may further include an elastic part which is disposed below the elevation part and generates an elastic force toward the elevation part so that the elevation part is raised when the catching boss is separated from the first catching step.

An upper side of the first catching step may be formed as an inclined surface corresponding to the catching boss, and when the elevation part is lowered, the catching boss may be seated on the first catching step while moving to a lower side of the first catching step along the inclined surface.

The retractable container may further include a support part which is fixedly disposed inside the cover part, has a second limitation boss in contact with a first limitation boss formed in the elastic piece when the pressing part is lowered, limits a lowering range of the pressing part, and prevents separation of the pressing part.

When the pressing part is raised, the second limitation boss may limit a raising range of the pressing part while in contact with the pressing part.

The pressing part may be provided with a support tube formed to extend toward the elevation part to guide elevation of the elevation part.

The elevation part may include an accommodation part in which the body part is accommodated, a first extension part that extends downward from a bottom surface of the accommodation part and is provided with the catching boss, and a second extension part that extends downward from the bottom surface of the accommodation part to be spaced apart from an inner surface of the first extension part, and the support tube may be inserted between the first extension part and the second extension part.

When the catching boss is seated on the first catching step, an upper end of the guide part may be in contact with a bottom surface of the elevation part to limit lowering of the elevation part.

Advantageous Effects

According to the present invention, a body part in which contents are accommodated can be changed between a locked state and a pop-up state while being extracted from or retracted into a cover part, and thus intuitive and convenient usability can be provided.

Further, according to the present invention, a structure is designed in which the body part protrudes upward from the cover part only when a pressing part provided at one end of the cover part is pressed, and thus the contents can be prevented from being exposed to the outside unintentionally by a user.

Further, according to the present invention, when the pressing on the pressing part is released, the pressing part is lowered by an elastic restoring force of an elastic piece to return to an original location thereof, and thus convenience in use can be improved.

DESCRIPTION OF DRAWINGS

A brief description of each drawing is provided to fully understand the drawings cited in detailed description of the present invention.

MODES OF THE INVENTION

Figure 1:
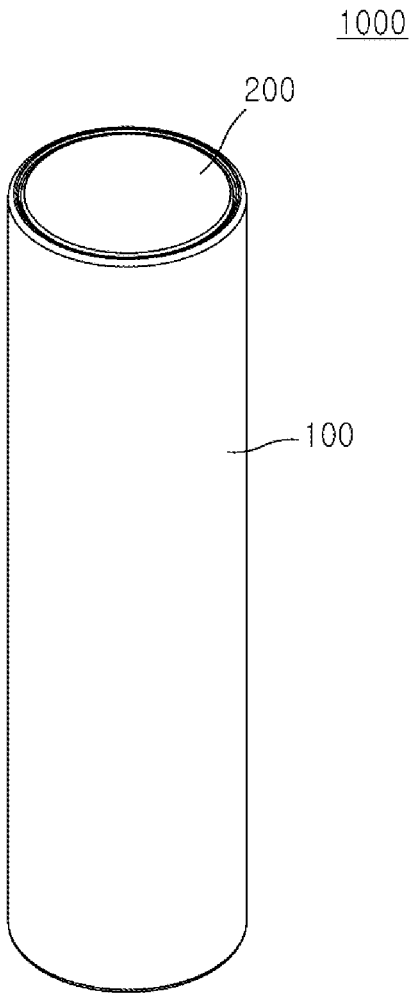
FIG. 1 is a perspective view illustrating a retractable container according to one embodiment of the present invention.

Hereinafter, exemplary embodiments of the present invention will be described in detail with reference to content described in the accompanying drawings. The same reference numerals or symbols presented in each drawing indicate parts or components that perform substantially the same function. Hereinafter, for convenience of description, the up, down, left, and right directions are based on the drawings, and the scope of the present invention is not necessarily limited to the corresponding directions.

Terms including ordinal numbers such as "first" and "second" may be used to describe various components, but the components are not limited by the terms. The terms are used only for the purpose of distinguishing one component from another component. For example, without departing from the scope of the present invention, a first component may be referred to as a second component, and similarly, a second component may be referred to as a first component. The term "and/or" includes any one item or a combination of a plurality of related items.

Terms used in the present specification are used only to describe embodiments and are not intended to limit and/or restrict the present invention. Singular expressions include plural expressions unless clearly otherwise indicated in the context. It should be understood in the present specification that terms such as "include" or "have" are intended to indicate that there are features, numbers, steps, operations, components, parts, or combinations thereof that are described in the specification and do not exclude in advance the possibility of the presence or addition of one or more other features, numbers, steps, operations, components, parts, or combinations thereof.

Throughout the specification, when a first part is connected to a second part, this includes not only a case in which the first part is directly connected to the second part but also a case in which the first part is indirectly connected to the second part with a third configuration therebetween. Further, when a part includes a component, this means that another component is not excluded but may be further included unless otherwise stated.

Figure 2:
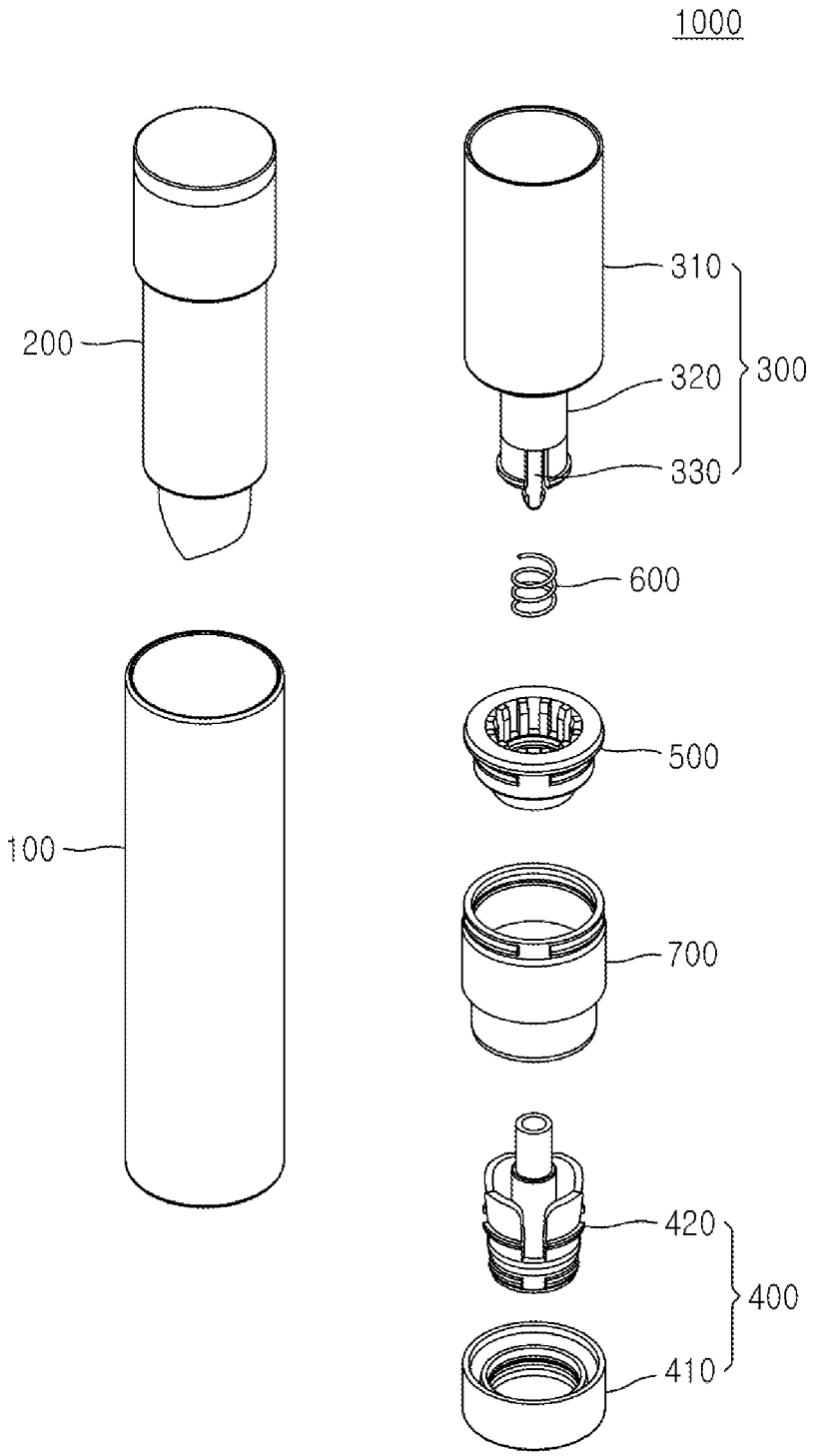
FIG. 2 is an exploded perspective view illustrating the retractable container according to one embodiment of the present invention.
Figure 3:
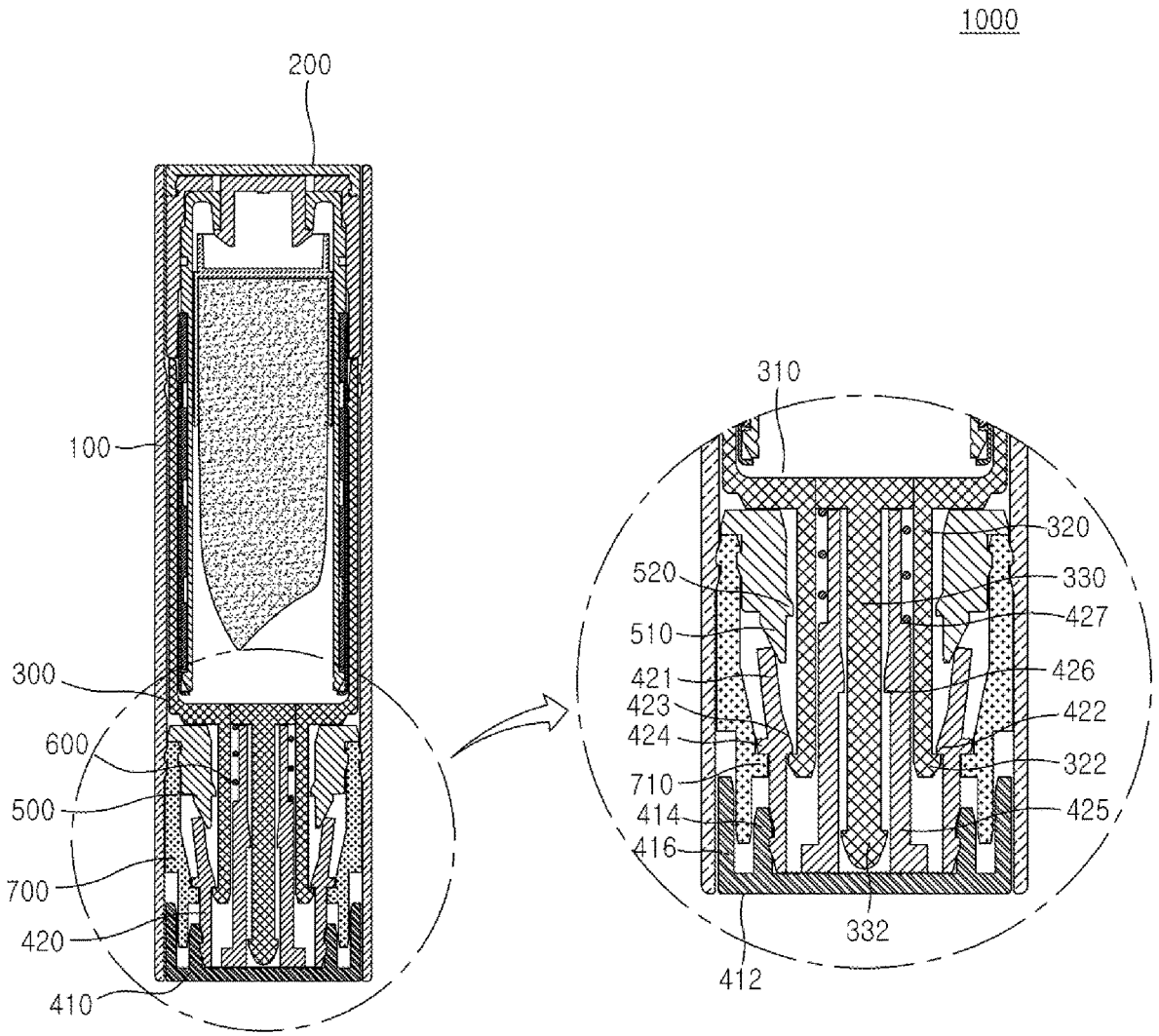
FIG. 3 is a cross-sectional view illustrating the retractable container according to one embodiment of the present invention.
Figure 4:
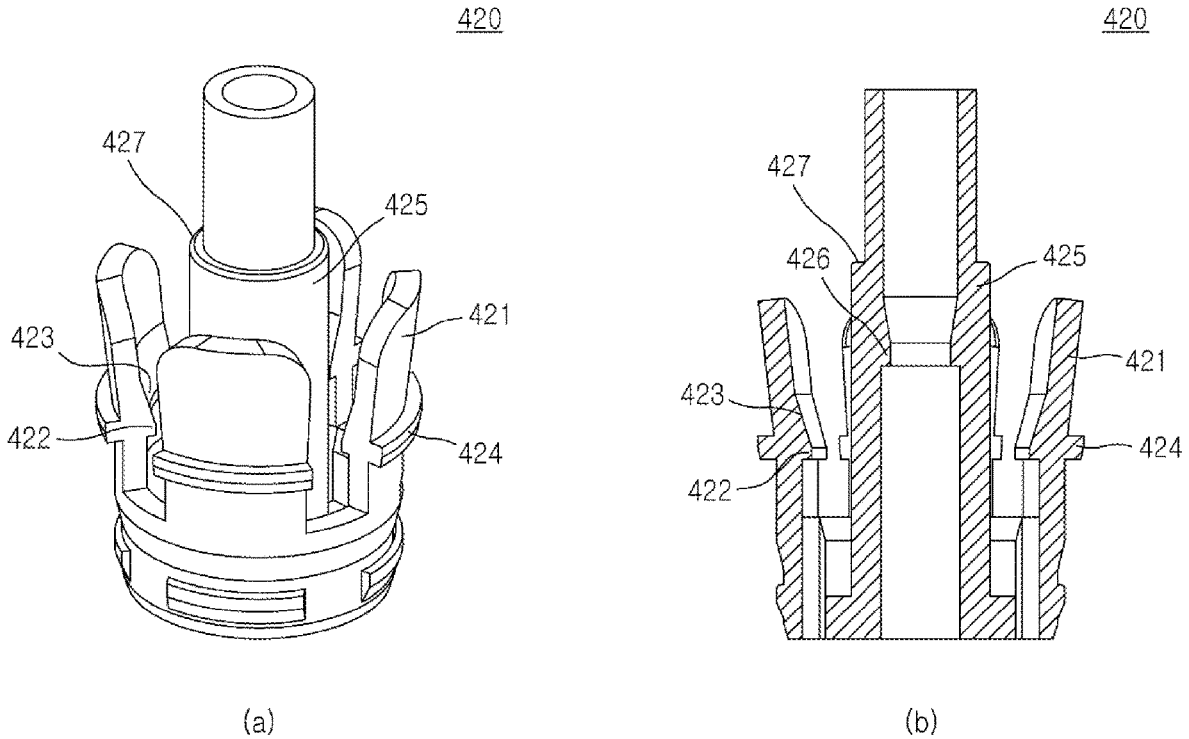
FIG. 4 illustrates a locking part of the retractable container according to one embodiment of the present invention.
Figure 5:
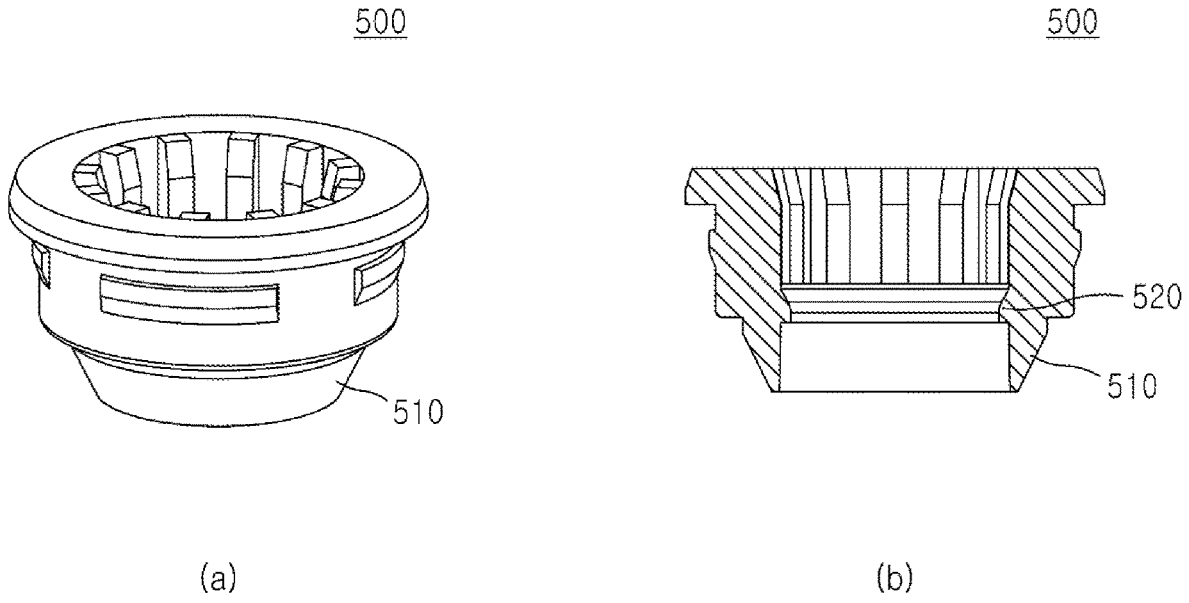
FIG. 5 illustrates a guide part of the retractable container according to one embodiment of the present invention.

FIG. 1 is a perspective view illustrating a retractable container according to one embodiment of the present invention, FIG. 2 is an exploded perspective view illustrating the retractable container according to one embodiment of the present invention, FIG. 3 is a cross-sectional view illustrating the retractable container according to one embodiment of the present invention, FIG. 4 illustrates a locking part of the retractable container according to one embodiment of the present invention, and FIG. 5 illustrates a guide part of the retractable container according to one embodiment of the present invention.

Referring to FIGS. 1 to 5, a retractable container 1000 may include a cover part 100, a body part 200, an elevation part 300, a pressing part 400, a guide part 500, an elastic part 600, and a support part 700.

The cover part 100 is formed in an up-down longitudinal direction, both ends thereof are open, and thus an accommodation space may be formed inside the cover part 100. Some components of the retractable container 1000, for example, the body part 200, the elevation part 300, the pressing part 400, the guide part 500, the elastic part 600, the support part 700, and the like may be provided to be fixed or movable in an up-down direction inside the cover part 100.

The body part 200 may be retracted or extracted through an open upper end of the cover part 100, and components for allowing the body part 200 to protrude upward, for example, the elevation part 300, the pressing part 400, the guide part 500, the elastic part 600, the support part 700, and the like, may be arranged at an open lower end of the cover part 100.

The body part 200 contains contents therein, is disposed on an inner upper side of the cover part 100, and is separated from the retractable container 1000 by operation of a user, and the user may use the contents through the body part 200.

A relative location between the cover part 100 and the body part 200 according to extraction or retraction of the body part 200 may be a criterion for distinguishing a locked state and a pop-up state of the body part 200. In detail, a state in which the body part 200 is disposed inside the cover part 100, the elevation of the elevation part 300 is fixed, and thus the extraction of the body part 200 is difficult may be the locked state. Further, a state in which at least a portion of the body part 200 protrudes to the outside of the cover part 100 by the elevation of the elevation part 300, and thus the user may grip the protruding body part 200 to separate the body part 200, may be the pop-up state.

The contents accommodated in the body part 200 may be a solid cosmetic. For example, the cosmetic may be a lipstick, a lip balm, or the like. In this case, the body part 200 may independently form a cosmetic such as a lipstick or a lip balm. However, the present invention is not limited thereto and may include various solid or semi-solid cosmetics according to the embodiments to which the present invention is applied. Further, according to the embodiments, the contents may include a medicine.

When separated from the cover part 100, the body part 200 may be a cosmetic that may be used independently. For example, the body part 200 may be configured as a lipstick container having a structure in which exposure of the contents is adjusted while the contents are elevated by a rotation operation of the user. For example, the body part 200 may include a holder in which the contents are mounted and a guide boss is formed, a rotating body rotated by the user, a protective tube having a spiral groove formed therein through which the guide boss moves, and an elevation guide part having a vertical groove formed therein to guide elevation of the guide boss. Accordingly, the exposure of the contents may be adjusted while the holder is elevated inside the protective tube by a rotation operation of the rotating body. However, the above configuration of the body part 200 is illustrative, and the structure of the body part 200 is not limited thereto and may be applied to various cosmetics.

The elevation part 300 may be disposed below the body part 200 and may be elevated inside the cover part 100. The extraction or retraction of the body part 200 from or into the cover part 100 may be adjusted through the elevation of the elevation part 300. The elevation part 300 may include an accommodation part 310, a first extension part 320, and a second extension part 330.

The accommodation part 310 is intended to accommodate the body part 200 and has an open upper end, and at least a portion of the body part 200 may be accommodated inside the accommodation part 310. In detail, the accommodation part 310 is formed in the form of a tube extending upward by a predetermined length to correspond to the body part 200, and at least a portion of an outer surface of the body part 200 may be accommodated in the accommodation part 310 while in close contact with an inner surface of the accommodation part 310. According to the embodiments, a close contact boss may be formed on the inner surface of the accommodation part 310 so that the body part 200 is in close contact with the inside of the accommodation part 310. Additionally, an outer surface of the accommodation part 310 may be in close contact with an inner surface of the cover part 100. This may prevent the body part 200 from being easily separated from the accommodation part 310 in a state in which the body part 200 is accommodated in the accommodation part 310 because the body part 200 is more closely and firmly in close contact with the inside of the accommodation part 310. However, this is illustrative, and various configurations may be applied according to the embodiments to which the present invention is applied. For example, the accommodation part 310 is not formed to extend long toward the upper side but may have a dish shape or a plate shape. Further, the accommodation part 310 may be configured as at least one leg extending toward the body part 200.

The first extension part 320 may be formed to extend downward from a bottom surface of the accommodation part 310, and a catching boss 322 may be formed to protrude outward from a lower end portion of the first extension part 320. The catching boss 322 may determine a location of the elevation part 300. In detail, the catching boss 322 may control the elevation of the elevation part 300 while seated on or separated from a first catching step 422 or a second catching step 520 of the pressing part 400. To facilitate catching matching, at least a portion of a lower portion of the first extension part 320 in which the catching boss 322 is formed may be cut and may be implemented to be elastically deformable while bent outward or inward.

The second extension part 330 may be formed to extend downward from the bottom surface of the accommodation part 310. In this case, the second extension part 330 may be spaced apart from an inner surface of the first extension part 320, and at least a portion of the pressing part 400 (in particular, a support tube 425 of a locking part 420) may be inserted into a separation space between an outer surface of the second extension part 330 and the inner surface of the first extension part 320.

In one embodiment, an auxiliary boss 332 may be formed to protrude outward from a lower end of the second extension part 330. When the elevation part 300 is elevated, the auxiliary boss 332 may be elevated while in contact with an inner surface of the support tube 425. Further, as the auxiliary boss 332 is supported by a locking step 426 of the support tube 425, raising of the elevation part 300 may be limited and/or the elevation part 300 may be prevented from being separated from the pressing part 400.

The pressing part 400 may be disposed below the elevation part 300 and may be elevated inside the cover part 100 according to pressing of the user. When an external force is applied, the elevation part 300 may be raised while the pressing part 400 is raised. When the external force is removed, the pressing part 400 may be lowered to return to an original location thereof. The elevation of the pressing part 400 causes the elevation of the elevation part 300 so that the body part 200 may be extracted from or retracted into the cover part 100. To this end, the pressing part 400 may include a button part 410 and the locking part 420.

The button part 410 may be disposed inside a lower portion of the cover part 100 and may receive an external force from the user through a pressing operation on an application surface 412 exposed to the outside of the cover part 100. An inner support 414 may be formed on an upper side of the application surface 412. Coupling bosses may be formed along a circumference of the inner support 414, and coupling grooves may be formed at a lower end of the locking part 420 to correspond thereto. Through fitting between the coupling bosses and the coupling grooves, the button part 410 and the locking part 420 may be coupled to each other to be integrally elevated. An outer support 416 may be formed to protrude to be spaced outward apart from the inner support 414. The outer support 416 may be in close contact with the inner surface of the cover part 100. Further, a lower end portion of the support part 700 may be retracted into or extracted from a separation space between the inner support 414 and the outer support 416 according to the elevation of the pressing part 400.

The locking part 420 may be coupled to an upper portion of the button part 410 through the inner support 414 and may adjust the elevation of the elevation part 300 in conjunction with the elevation part 300 and the guide part 500. To this end, an elastic piece 421 that may be elastically deformed according to the elevation of the pressing part 400 may be formed in the locking part 420, and the first catching step 422 may be formed on an inner surface of the elastic piece 421. The elastic piece 421 may be formed outside the locking part 420 in an up-down direction, and at least a portion of the elastic piece 421 may be cut for lateral bending and recovery.

When the catching boss 322 is seated on the first catching step 422, the elevation of the elevation part 300 may be limited, and accordingly, raising of the body part 200 may also be limited. In this case, when the pressing part 400 is raised, the catching boss 322 may be separated from the first catching step 422 while the elastic piece 421 is bent outward by the guide part 500. Due to the separation, the elevation part 300 may be raised. Thereafter, when the pressing is removed, as the outward bending of the elastic piece 421 is released by an elastic restoring force of the elastic piece 421, the pressing part 400 may be lowered.

An upper side of the first catching step 422 may be formed as an inclined surface 423 corresponding to the catching boss 322. In detail, an upper region of the first catching step 422 may be formed as the inclined surface 423 inclined outward toward the upper side, and the catching boss 322 may be seated on the first catching step 422 while moving to the lower side of the first catching step 422 along the inclined surface 423.

A first limitation boss 424 may be formed on an outer surface of the elastic piece 421. The first limitation boss 424 may limit downward movement of the pressing part 400 and prevent the separation of the pressing part 400 while in contact with a second limitation boss 710 of the support part 700.

The support tube 425 that extends toward the elevation part 300 and guides the elevation part 300 so that the elevation part 300 is stably elevated may be provided inside the locking part 420. The support tube 425 may extend upward from an inner lower surface of the locking part 420 by a predetermined length and may be formed to be spaced inward apart from the elastic piece 421.

The support tube 425 is inserted into a separation space between the first extension part 320 and the second extension part 330 of the elevation part 300, at least a portion of the support tube 425 is in contact with the first extension part 320 and the second extension part 330, and thus the elevation part 300 may be stably elevated without shaking in a left-right direction while being elevated.

The locking step 426 may be formed on the inner surface of the support tube 425. When the elevation part 300 is raised, the upward movement of the elevation part 300 may be limited while the auxiliary boss 332 of the second extension part 330 is in contact with the locking step 426. Further, an elastic support part 427 may be formed in an upper region of the support tube 425 so that the elastic part 600 may be disposed.

The guide part 500 may be fixedly disposed inside the cover part 100 and guide the elastic deformation of the elastic piece 421 when the pressing part 400 is elevated. In detail, a guide surface 510 having a predetermined inclination may be formed at a lower portion of the guide part 500. The guide surface 510 may be formed to have an outwardly upward inclination. Thus, when the elastic piece 421 is raised, an upper end of the elastic piece 421 may be bent outward along the upwardly inclined guide surface 510.

Further, the second catching step 520 may be formed on an inner surface of the guide part 500. The catching boss 322 is seated on the second catching step 520, and thus a raising range of the elevation part 300 may be limited, and the separation of the elevation part 300 may be prevented.

That is, when the catching boss 322 is separated from the first catching step 422 due to the outward bending of the elastic piece 421, the elevation part 300 is raised by the elastic part 600. In this raising process, when the catching boss 322 of the elevation part 300 is in contact with the second catching step 520, the raising of the elevation part 300 is finished, and the elevation part 300 may be prevented from being separated from the cover part 100 by being separated to the outside of the guide part 500 due to catching.

The elastic part 600 may generate an elastic force toward the elevation part 300 so that the elevation part 300 is raised. In detail, when the catching boss 322 is seated on the first catching step 422, the elastic part 600 may be compressed to exhibit the elastic force toward the elevation part 300. Despite the elastic force, the raising of the elevation part 300 is limited by the catching boss 322 and the first catching step 422. In this case, when the catching boss 322 is separated from the first catching step 422, the elastic force of the elastic part 600 is applied toward the elevation part 300, and thus the elevation part 300 may be raised. The elastic part 600 may be implemented as any of various members which may exhibit an elastic force, such as a spring.

The elastic part 600 may be disposed between the elevation part 300 and the pressing part 400. In detail, a lower end of the elastic part 600 may be disposed in the elastic support part 427 formed above the support tube 425 of the locking part 420. The upper end of the elastic part 600 may be disposed on the bottom surface of the accommodation part 310 of the elevation part 300. The elastic part 600 may be supported by the inner surface of the first extension part 320 on the outside and supported by an outer surface of the support tube 425 on the inside. Thus, the elastic part 600 may be stably compressed or tensioned according to the elevation of the elevation part 300 with respect to the pressing part 400.

The support part 700 may be fixedly disposed inside the cover part 100, limit a lowering range of the pressing part 400, and prevent the separation of the pressing part 400.

In detail, coupling bosses may be formed on an outer surface of the support part 700 along a circumference thereof, and coupling grooves may be formed in the inner surface of the cover part 100 to correspond thereto. As the coupling bosses of the support part 700 are fitted in the coupling grooves of the cover part 100, the support part 700 may be coupled to the inside of the cover part 100. Further, coupling grooves may be formed in an upper inner surface of the support part 700 along a circumference thereof, and coupling bosses may be formed on an outer surface of the guide part 500 to correspond thereto. As the coupling bosses of the guide part 500 are fitted into the coupling grooves of the support part 700, the guide part 500 may be coupled to the support part 700 and the cover part 100.

The locking part 420 may be elevated inside the support part 700, and in this case, the support part 700 may limit the raising range and the lowering range of the locking part 420. To this end, the second limitation boss 710 may be formed on an inner surface of the support part 700.

In detail, when the elastic piece 421 is lowered, the second limitation boss 710 supports the first limitation boss 424, and thus the elastic piece 421 may be prevented from being lowered and the pressing part 400 may be prevented from being separated from the cover part 100. Further, when the pressing part 400 is raised, an upper end of the inner support 414 is supported by the second limitation boss 710, and thus the raising may be limited.

Figure 6:
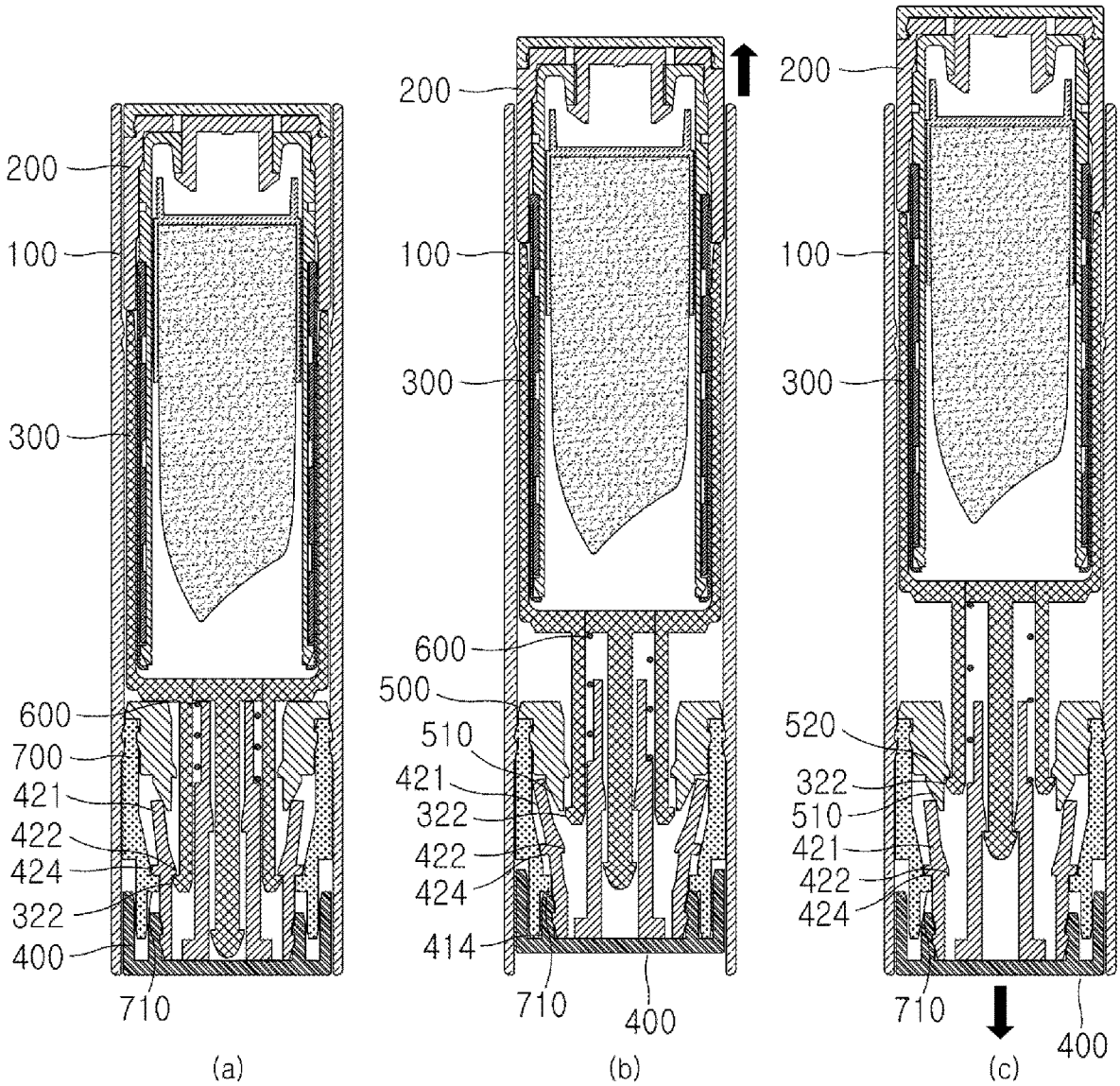
FIG. 6 illustrates operations of the retractable container according to one embodiment of the present invention.

FIG. 6 illustrates operations of the retractable container according to one embodiment of the present invention.

FIG. 6A illustrates a locked state of the body part 200. In the locked state, as the catching boss 322 is seated on the first catching step 422, the raising of the elevation part 300 may be limited. In this case, as the first limitation boss 424 formed outside the elastic piece 421 is seated and supported on an upper portion of the second limitation boss 710 of the support part 700, the pressing part 400 may be disposed so as not to be separated from the lower portion of the cover part 100. Further, as long as no external force is applied to the pressing part 400 as the elastic part 600 applies an elastic force toward the elevation part 300, the catching boss 322 is supported by the first catching step 422, and thus the rising limiting state may be maintained.

In the locked state, the body part 200 is completely accommodated inside the cover part 100 and thus may not protrude upward from the cover part 100. However, the present invention is not limited thereto, and according to embodiments, the locked state may include a state in which the body part 200 protrudes upward from the cover part 100 within a predetermined range.

FIG. 6B illustrates a transition state in which the body part 200 is changed from the locked state to the pop-up state by pressing the pressing part 400. When the pressing part 400 is pressed in the locked state, as the pressing part 400 is raised, the catching boss 322 is separated from the first catching step 422, and thus the elevation part 300 may be raised by the elastic part 600.

In detail, when the pressing part 400 is raised, the elastic piece 421 is bent outward along the guide surface 510, the catching step 422 is moved from the catching boss 322 in a lateral direction as the elastic piece 421 widens to the outside, and thus the catching boss 322 may be separated from the first catching step 422. In this way, when the raising limitation of the elevation part 300 is released, the elevation part 300 is raised by the elastic force of the elastic part 600, the body part 200 is pushed upward, and thus one end of the body part 200 may protrude while moving toward the upper side of the cover part 100. In this case, the elevation part 300 may be pressed and raised only until the upper end of the inner support 414 is in contact with a lower portion of the second limitation boss 710, and thus a raising range of the pressing part 400 may be limited.

FIG. 6C illustrates the pop-up state of the body part 200. The elevation part 300 may be raised by the pressing until the catching boss 322 separated from the first catching step 422 is seated on the second catching step 520 of the guide part 500, and when the catching boss 322 is seated on the second catching step 520 of the guide part 500, the raising of the elevation part 300 is completed.

In this way, a current state is changed to the pop-up state in which at least a portion of the body part 200 protrudes upward from the cover part 100 by a predetermined height, and thus the user may grip the protruding body part 200 to extract the body part 200 from the cover part 100.

In this state, when the pressing of the pressing part 400 is released, the elastic piece 421 that is bent outward along the guide surface 510 may return to an original state thereof while being gathered inward again by the elastic restoring force. As the elastic piece 421 is lowered along the guide surface 510 while the elastic piece 421 returns to an original state thereof, the pressing part 400 may be lowered. In this case, the pressing part 400 may be lowered until the first limitation boss 424 comes into contact with the second limitation boss 710 and thus may return to an original location thereof before the button part 410 is raised.

Meanwhile, in the pop-up state of the body part 200, when the body part 200 is pressed downward to lower the elevation part 300, the catching boss 322 is seated on the first catching step 422 again, and thus the current state may be changed to the locked state. The user may change the body part 200 to the locked state or the pop-up state through a simple pressing operation on the pressing part 400 or the body part 200, and thus convenience of use can be increased.

Figure 7:
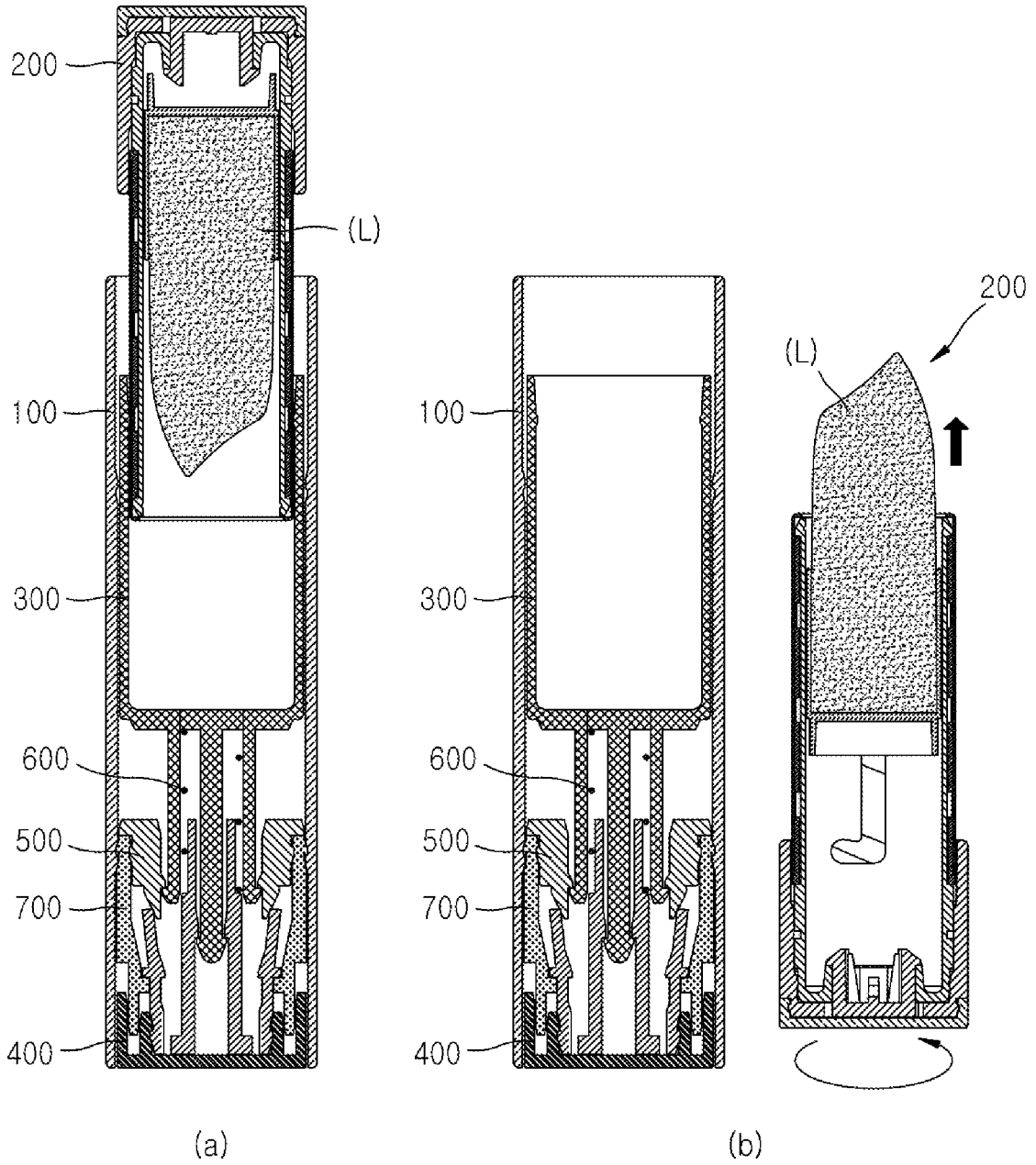
FIG. 7 illustrates an example of use of the retractable container according to one embodiment of the present invention.

FIG. 7 illustrates an example of use of the retractable container according to one embodiment of the present invention.

Referring to FIG. 7A, in order for the user to use a lipstick L accommodated in the body part 200, the user may press the pressing part 400 to change the body part 200 in the locked state to the pop-up state, and when the one end of the body part 200 protrudes upward from the cover part 100 by a predetermined height as the body part 200 is changed to the pop-up state, the user may grip the one end of the body part 200, pull the one end of the body part 200 upward, and extract the body part 200 from the cover part 100.

Subsequently, referring to FIG. 7B, in a state in which the body part 200 is extracted from the cover part 100, the user may expose the lipstick L to the outside through operation of the body part 200 and use the lipstick L. Thereafter, when the use of the lipstick L is completed, the user may insert the body part 200 into an open upper end of the cover part 100, press the body part 200 downward, and change the body part 200 to the locked state.

Hereinabove, the coupling between the components has been described as the coupling between the bosses and the grooves or the coupling between the bosses. However, this is illustrative, and various coupling methods can be applied according to the embodiments. For example, the bosses and the grooves may be switched with each other or screw coupling may be applied.

Although the embodiments have been described above with reference to the limited embodiments and the limited drawings, various modifications and changes may be made based on the above description by those skilled in the art. Further, respective embodiments may be operated in combination with each other as needed. Therefore, other implementations, other embodiments, and equivalents to the appended claims also belong to the scope of the appended claims.

The invention claimed is:

1. A retractable container comprising:

a cover part having two open ends;

a body part disposed in an inner upper portion of the cover part and accommodating a content therein;

an elevation part disposed at a lower end of the body part and configured to be raised inside the cover part, the elevation part comprising a catching boss for determining a seating location;

a pressing part disposed below the elevation part and configured to be raised inside the cover part according to a pressing of a user, the pressing part comprising an elastic piece; and a guide part fixedly disposed on an upper side of the pressing part and comprising a guide surface in contact with an upper end of the elastic piece, wherein, when the catching boss is seated on a first catching step disposed on the elastic piece, raising of the elevation part and the body part is limited, and when the pressing part is raised by the pressing of the user, the elastic piece is bent along the guide surface, the catching boss is separated from the first catching step, the elevation part is raised, and at least a portion of the body part protrudes from the cover part.

2. The retractable container of claim 1, wherein, when the pressing of the user is removed, the bending of the elastic piece along the guide surface is released by a restoring force of the elastic piece, and the pressing part is lowered to return to an original position thereof.

3. The retractable container of claim 1, wherein, when the catching boss separated from the first catching step is seated on a second catching step disposed on the guide part, the raising of the elevation part is limited, and separation of the elevation part from the cover part is prevented.

4. The retractable container of claim 1, further comprising an elastic part disposed below the elevation part and generating an elastic force toward the elevation part, wherein the elevation part is raised by the elastic force of the elastic part when the catching boss is separated from the first catching step.

5. The retractable container of claim 1, wherein an upper side of the first catching step is an inclined surface corresponding to the catching boss, and when the elevation part is lowered, the catching boss moves along the inclined surface to a lower side of the first catching step and is seated on the first catching step.

6. The retractable container of claim 1, further comprising a support part fixedly disposed inside the cover part and comprising a second limitation boss, wherein, when the pressing part is lowered, the second limitation boss of the support part is in contact with a first limitation boss disposed in the elastic piece, and the support part limits a lowering range of the pressing part and prevents separation of the pressing part from the cover part.

7. The retractable container of claim 6, wherein, when the pressing part is raised, the second limitation boss is in contact with the pressing part and limits a raising range of the pressing part.

8. The retractable container of claim 1, wherein the pressing part comprises a support tube extending toward the elevation part to guide the raising of the elevation part.

9. The retractable container of claim 8, wherein the elevation part further comprises:

an accommodation part accommodating the body part;

a first extension part extending downward from a bottom surface of the accommodation part and comprising the catching boss; and a second extension part extending downward from the bottom surface of the accommodation part and spaced apart from an inner surface of the first extension part, and wherein the support tube of the pressing part is inserted between the first extension part and the second extension part.

10. The retractable container of claim 1, wherein, when the catching boss is seated on the first catching step, an upper end of the guide part is in contact with a bottom surface of the elevation part to limit lowering of the elevation part.

* * * * *